United States Patent [19]

Stange

[11] 3,948,507

[45] Apr. 6, 1976

[54] COPY STRIPPER

[75] Inventor: Klaus K. Stange, Pittsford, N.Y.

[73] Assignee: Xerox Corporation, Stamford, Conn.

[22] Filed: Nov. 25, 1974

[21] Appl. No.: 526,874

[52] U.S. Cl. ..... 271/174; 271/DIG. 2

[51] Int. Cl.[2] ..... B65H 29/56

[58] Field of Search ..... 271/DIG. 2, 80, 174; 432/60; 118/245; 355/3 R

[56] References Cited

UNITED STATES PATENTS

| | | | |
|---|---|---|---|
| 2,559,908 | 7/1951 | Warren | 118/245 |
| 3,804,401 | 4/1974 | Stange | 271/DIG. 2 |

*Primary Examiner*—John J. Love
*Assistant Examiner*—Robert Saifer

[57] ABSTRACT

A sheet stripping finger adapted for substantially planar movement into and out of engagement with a moving support surface for removing individual sheets of material therefrom. The stripper finger, is supported and biased toward the moving support surface by a plurality of parallel flexure blades which are disposed substantially perpendicular to the plane of movement of the stripper finger. Lever means are provided to move the stripper finger away from the support surface against the force of the flexure blades after the sheet material has been stripped from the support surface.

1 Claim, 2 Drawing Figures

COPY STRIPPER

BACKGROUND OF THE INVENTION

This invention relates to a sheet stripping device, and in particular, to apparatus for supporting a sheet stripping finger at a predetermined position and for moving the stripping device into and out of engagement with a moving sheet support surface from which a sheet of material is to be removed.

In many automatic copying machines, and in particular, in the automatic xerographic copying process, it is important to unerringly and repeatedly remove copy sheets from the photoreceptor surface (photosensitive plate) during the course of the copying process. When the sheet removal or stripping device fails, the copy sheet carried on the photoreceptor surface is generally carried forward into subsequent processing stations where the sheet can produce a malfunctioning of the stations involved or, in the extreme case, cause damage to the machine.

Due to the fact that the photoreceptor surface in a xerographic machine may be easily damaged by mechanical contact therewith, various non-contact stripping devices have been proposed. One of the more common type devices is the vacuum stripper wherein the sheet of material to be removed is pulled off from the photoreceptor surface by vacuum. This requires a fairly large vacuum and precise location and design of the vacuum stripping ports to assure positive stripping in all instances. Further, under abnormal conditions, the sheet may still adhere to the photoreceptor surface and be carried therewith into subsequent processing stations causing damage to the machine and destruction of the sheet. "Puffer" stripping systems have also been utilized. These systems, which rely on a blast of air against the lead edge of the sheet material to be removed, usually require a large volume of high pressure air. These air blasts are generally discharged a significant distance away from the copy. This leads to air turbulances in the machine, which, in the case of unfused copy, leads to toner disturbances on the copy sheet with resultant deterioration of copy quality. In order to conserve air, these devices are normally employed in a pulse mode which requires timing in relationship to the lead edge of the sheet to be stripped. This timing must be accurate. If the blast of air occurs too soon, the energy has been exhausted before the lead edge of the sheet of material arrives. If the blast occurs too late, the air will actually push the material down on the photoreceptor rather than remove it therefrom. Normally, these air nozzels are not capable of discharging the complete air blast below the lead edge of the sheet; some of the air will always react against the top of the sheet and tend to push the sheet down against the photoreceptor surface.

Mechanical stripping devices such as those disclosed in U.S. Pat. Nos. 3,578,859 and 3,450,402 have been used for quite some time in the copying art with varying degrees of success. However, mechanical stripping devices must be accurately aligned and through use may be subject to misalignment problems whereby the stripping mechanism fails to act upon the sheet at the proper place. As a result, the sheet either remains on the support surface or is distorted during the removal operation, thus causing the machine to malfunction. Further, where a mechanical pickoff finger is introduced between the photoreceptor and the sheet material carried thereon, misalignment of the finger can also cause the finger to contact and abrade the relatively delicate photosensitive plate surface thereby necessitating frequent replacement of the photoreceptor. In designing stripper fingers and the mounts therefore, one of the primary considerations must be the provision of a structure which will minimize bounce during the moment of stripping and be capable of lifting the copy off the photoreceptor without smudging the image and without damaging the photoreceptor.

To minimize wear on the photoreceptor surface it is desirable to move the stripper finger out of operating position after stripping has been accomplished. Many devices heretofore utilized having various pivots, crank pins etc. have a tendency to become contaminated with toner resulting in sluggish movement of the finger toward the photoreceptor surface. This may cause the stripper finger to miss the lead edge of the sheet material to be stripped. Further, in those stripper finger constructions wherein the stripper finger is solidly mounted on crank pins and arms, the impact force of the copy against the finger is transmitted directly against the photoreceptor and the underside of the stripper finger, causing undesirable wear and premature failure of the photoreceptor and stripping finger.

It is therefore an object of the present invention to provide a movable stripper finger, the operation of which is not effected by contamination with materials such as toner and paper fibers, which will absorb impact loading during stripping to prevent the impact from being translated into a high loading of the tip against the support surface and which is not subjected to misalignment or bounce during operation of the machine.

SUMMARY OF THE INVENTION

This application relates to a sheet stripping device for removing a sheet of material from a moving support surface including a sheet stripping finger movable into and out of contact with the moving support surface, a plurality of flexure blades resiliently supporting the sheet stripping finger, the flexure blades being substantially parallel to each other and perpendicular to the plane of movement of the stripping finger, the flexure blades biasing the stripper finger against the moving support surface. Actuable lever means are provided for contacting the stripper finger to move the stripper finger away from the moving support surface in opposition to the biasing force of the flexure blades.

DESCRIPTION OF THE PREFERRED EMBODIMENT

Figure 1:
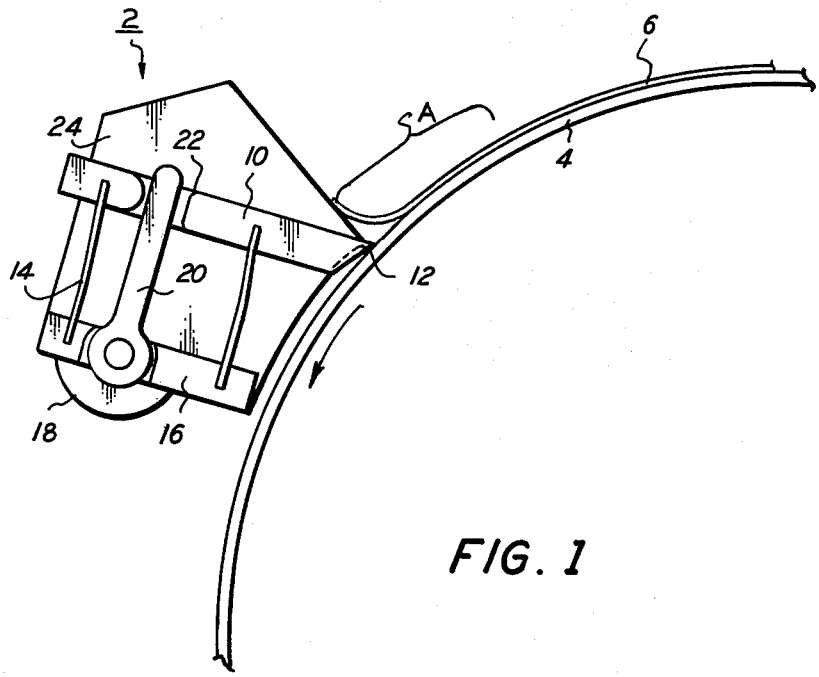
FIG. 1 is a schematic view of a sheet stripping device employing the teachings of the present invention illustrating a copy sheet in the process of being removed from the surface of a moving photoconductive drum.
Figure 2:
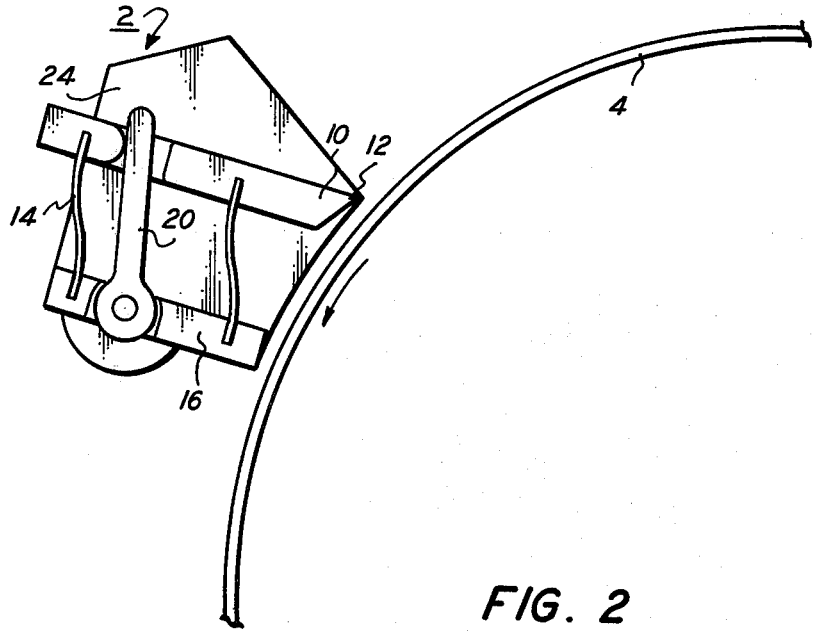
FIG. 2 is a schematic view of the sheet stripping device of FIG. 1 illustrating the sheet stripping device in the inoperative position.

Referring now to FIGS. 1 and 2, there is shown a sheet stripping device embodying the teachings of the present invention. The sheet stripping device will be herein described in reference to an automatic xerographic process of the type disclosed in greater detail in U.S. Pat. Nos. 3,090,616 and 3,578,859. However, it should be understood that the invention is not limited thereto but may be utilized in any embodiment wherein a sheet of material is to be removed from a moving support surface.

As previously noted in the aforementioned patents, in the xerographic process, a latent electrostatic image of an original to be copied is first recorded upon a moving photoconductive plate surface and the image is then rendered visible by applying a specially prepared charged toner material to the plate surface. A sheet of final support material, such as paper or the like, is placed in overlying contact with the imaged plate surface and the toner image is transferred from the plate to the copy sheet. During the image transfer step, the copy sheet normally becomes electrostatically tacked to the plate. The removal of the tacked sheet from the plate has posed a long standing problem in the xerographic art. As shown in the drawings, a stripping device is positioned adjacent and in close non-contiguous relation to a moving xerographic drum 4 of the type commonly known and used in the art. The drum basically consists of a conductive substrate over which is placed a photoconductive layer, as for example, selenium. The drum is mounted upon a shaft (not shown) and arranged to rotate in the direction indicated. A sheet of final support material 6, to which the toner image has been previously transferred, is shown being carried forward on the drum surface into the sheet stripping or removal zone A.

The stripping device generally includes a stripper finger 10, having a pointed end 12 thereon. Flexure tabs 14 rigidly mounted at their lower ends to the frame of the machine or a sub frame 16 which in turn would be rigidly mounted to the frame of the machine, are adapted for supporting the stripper finger.

The flexure tabs 14 are arranged to bias the pointed end 12 of stripper finger 10 into contact with the rotating drum 4. A spring loaded rotary solenoid 18 is provided with an actuator arm 20 adapted for cooperation with a slot 22 in stripper finger 10 for moving the stripper finger 10 out of contact with drum 4 after the sheet 6 has been stripped therefrom. In FIG. 1 the solenoid is illustrated in the actuated position which locates the arm 20 in such a position in slot 22 that it is out of contact with the stripper finger 10. This allows uninterrupted movement of the stripper finger 10 in a plane parallel to the direction of movement of the stripper finger to allow the finger to follow the contour of the drum. This provides one of the major advantages of the instant invention. Due to the normally encountered tolerances in the drum which result in a non-perfect cylindrical surface and run out normally encountered in the shaft upon which the drum is mounted, the flexure tabs allow the finger to follow the drum surface during the stripping operation irrespective of cylindrical inconsistencies and drum run out. When the solenoid 18 is de-energized, the return spring therein causes arm 20 to assume the position illustrated in FIG. 2 to maintain the stripper finger 10 out of contact with the drum. When it is desired to move the stripper finger into contact with the drum, due to the almost instantaneous movement of the arm 20 to the position illustrated in FIG. 1, the finger 10 is rapidly moved into contact with the drum. Since the arm 20 does not contact the stripper finger 10 when the finger is adjacent the drum 4, as the finger 10 is moved to the drum, the only impact force between the finger 10 and the drum is that caused by the flexure tabs 14. The actuating force of the solenoid 18 is prevented from forcing the finger 10 against the drum due to the location of the slot 22 and the finger arm as illustrated in FIG. 1.

The flexure tabs 14 not only allow the finger 10 to follow the contour of the drum and provide a minimal predetermined impact force of the finger against the drum when solenoid 18 is actuated, but also provides a shock absorbing effect when the lead edge of the paper contacts the stripper finger to prevent an undue shock force from being transmitted by the pointed end 12 of the finger to the drum.

Suitable stripper rails 24 may be provided on both sides of stripper finger 10 (only one of which is illustrated) to guide the stripped paper over the stripper finger mechanism to subsequent take-away rolls or mechanisms downstream therefrom. The top surfaces of the stripper rails are extended to a location closely adjacent drum 4 to guide the sheet 6 off from the stripper finger as soon as it is stripped from the drum and remove the sheet loading from the stripper finger as rapidly as possible. Further, for ease of assembly, the front surfaces of rails 24 are formed to correspond to the curvature of the drum to simplify guaging the proper assembly position of the stripping device relative to the drum. Due to the shape of the top and front surfaces of the rails, when the stripper finger is retracted, it is completely protected by the rails, thereby preventing damage to the pointed end 12 thereof during drum replacement or other repairs for adjustments of the machine. The stripper rails are mounted a suitable distance from the stripper finger 10 on either side thereof to prevent toner particles or paper fibers which may collect therein from impeding free movement of the stripper finger toward and away from the photoreceptor drum 4.

It can be seen from the foregoing that the stripper finger assembly is capable of rapid movement into stripping position, is capable of following imperfections in the curvature of the photoreceptor drum and will follow the drum surface irrespective of run out caused by initial drum mounting tolerances or wear of the photoreceptor drum shaft bearing. The flexure tabs providing these advantages also act as shock absorbers to cushion the initial shock generated by the lead edge of the sheet hitting the stripper finger. Further, due to the orientation of the finger relative to the drum and planar movement of the finger into contact with the drum, wear of the pointed tip of the finger will result in a sharp edge being maintained thereon as contrasted to the wear encountered with pivotal type stripper fingers which results in a rounded tip due to arcuate movement of the finger into contact with the drum.

While I have described a preferred embodiment of my invention, it is to be understood that the invention is not limited thereto but may be otherwise embodied within the scope of the following claims.

What is claimed is:

1. A sheet stripping device for removing a sheet of material from a moving support surface comprising:

a sheet stripping finger provided with an opening therein, said finger being adapted for substantially planar movement into and out of contact with the moving support surface;

spring means for biasing said stripper finger against said moving support surface, said spring means comprising a plurality of flexure blades resiliently supporting said sheet stripping finger, said flexure blades being substantially parallel to each other and perpendicular to the plane of movement of said stripping finger;

means for moving said stripper finger away from the moving support surface in opposition to the biasing force of said spring means including a rotary solenoid; and, lever means connected to said rotary solenoid, said lever means projecting through the opening in said stripper finger, said rotary solenoid being biased toward a first position, said lever acting against the edge of the opening in said stripper finger to move said stripper finger away from the moving support surface when said solenoid is de-energized, said solenoid moving said lever to a second position upon energization thereof, movement of said lever means to said second position allowing said stripper finger to contact the moving support surface, said lever means being out of contact with said stripper finger when said solenoid is actuated to allow said stripper finger to freely follow the contour of said moving support surface.

* * * * *